US008757680B2

(12) United States Patent
Byun

(10) Patent No.: US 8,757,680 B2
(45) Date of Patent: Jun. 24, 2014

(54) DOOR LOCK ASSEMBLY

(75) Inventor: Yong Soo Byun, Suwon-si (KR)

(73) Assignee: Leehan Door Corporation, Pyeongtaek-si (KR)

( * ) Notice: Subject to any disclaimer, the term of this patent is extended or adjusted under 35 U.S.C. 154(b) by 483 days.

(21) Appl. No.: 13/039,575

(22) Filed: Mar. 3, 2011

(65) Prior Publication Data

US 2011/0214460 A1 Sep. 8, 2011

(30) Foreign Application Priority Data

Mar. 4, 2010 (KR) ..... 10-2010-0019272
Mar. 4, 2010 (KR) ..... 10-2010-0019279
Mar. 4, 2010 (KR) ..... 10-2010-0019280

(51) Int. Cl.
*E05C 3/06* (2006.01)
*E05B 65/12* (2006.01)
*E05C 3/00* (2006.01)

(52) U.S. Cl.
CPC ..... *E05B 81/14* (2013.01); *E05B 81/12* (2013.01); *E05B 81/00* (2013.01)
USPC ..... 292/201; 292/216

(58) Field of Classification Search
USPC ..... 292/201, 216
See application file for complete search history.

(56) References Cited

U.S. PATENT DOCUMENTS 4,395,064 A * 7/1983 Bellot et al. ..... 292/201
4,518,180 A * 5/1985 Kleefeldt et al. ..... 292/201
4,793,640 A * 12/1988 Stewart, Sr. ..... 292/201
4,815,775 A * 3/1989 Mertin et al. ..... 292/201
5,066,054 A * 11/1991 Ingenhoven ..... 292/201
5,564,308 A * 10/1996 Hoshikawa et al. ..... 74/89.14
5,615,564 A * 4/1997 Inoue ..... 70/279.1
5,634,677 A * 6/1997 Buscher et al. ..... 292/216
5,746,076 A * 5/1998 Inoue ..... 70/277
5,833,282 A * 11/1998 Ikeda ..... 292/201
7,055,872 B2 * 6/2006 Hayakawa et al. ..... 292/216

FOREIGN PATENT DOCUMENTS

KR 10-0736907 B1 7/2007
KR 10-0851144 B1 8/2008

OTHER PUBLICATIONS

International Search Report dated Apr. 25, 2011 from Korean Appln No. 10-2010-0019279.

* cited by examiner

*Primary Examiner* — Carlos Lugo
(74) *Attorney, Agent, or Firm* — Ohlandt, Greeley, Ruggiero & Perle, LLP

(57) ABSTRACT

A door lock assembly is provided. The door lock assembly includes a lock lever connected to a knob, an inter-lever connected to the lock lever, a first lock device connected to the inter-lever and reciprocating the inter-lever, and a second lock device disposed on one side of the first lock device and locking the inter-lever.

6 Claims, 11 Drawing Sheets

DOOR LOCK ASSEMBLY

CROSS-REFERENCE TO RELATED APPLICATION

This application claims priority to and the benefit of Korean Patent Application Nos. 10-2010-0019272 filed in the Korean Intellectual Property Office on Mar. 4, 2010, 10-2010-0019279 filed in the Korean Intellectual Property Office on Mar. 4, 2010, 10-2010-0019280 filed in the Korean Intellectual Property Office on Mar. 4, 2010, the entire contents of which are incorporated herein by reference.

BACKGROUND OF THE INVENTION

1. Field of the Invention

The present invention relates to an assembly, and more particularly, to a door lock assembly.

2. Description of the Related Art

Door lock assemblies generally mean devices for locking or unlocking a door of a vehicle. An outside user can remotely operate a door lock assembly through a remote controller. Further, the user can manually operate the door lock assembly by using a key.

In particular, recently, the outside user can operate a door lock assembly by inputting a signal through a remote controller using infrared communication. In this case, in general, a motor rotates by the signal input through the remote controller so as to operate the door lock assembly.

If the user inputs the signal, the door lock assembly is switched to a locking or unlocking state. In this case, the structure of the door lock assembly is determined by the position of the motor and a structure transmitting the action force of the motor.

Meanwhile, the user locks or unlocks the door by a lock device included in the door lock assembly. In this case, the door lock assembly generally includes one lock device.

However, even when the user locks the door by using the door lock assembly, the door may be opened from the outside and the vehicle may be stolen or damaged. Therefore, in order to solve the problem, a device for doubly locking the door is necessary. Further, it is necessary to simplify a structure while including the above-mentioned function.

In particular, since the lock device is generally operated by electricity, in the case where the battery of the vehicle is discharged or damaged or the lock device is damaged, it is impossible to unlock the doubly locked door. Therefore, it is necessary for the user to insert the key to manually open the door.

Meanwhile, the door lock assembly is necessarily disposed in the door of the vehicle. Therefore, in order to reduce the cost in producing a vehicle, reducing the manufacture cost of the door lock assembly is an important issue in the automobile industry.

SUMMARY OF THE INVENTION

The present invention has been made in an effort to provide a door lock assembly having advantages of preventing a vehicle from being stolen and preventing a doubly locked door from being unlocked.

An exemplary embodiment of the present invention provides a door lock assembly including a lock lever connected to a knob, an inter-lever connected to the lock lever, a first lock device connected to the inter-lever and reciprocating the inter-lever, and a second lock device disposed on one side of the first lock device and restricting the inter-lever.

On one side of the inter-lever, a first elongated hole may be formed to be connected to the second lock device.

At least a portion of the first elongated hole may be formed in a direction different from a longitudinal direction of the inter-lever.

The second lock device may include a second drive unit, and a double lock gear connected to the second drive unit.

One side of the double lock gear may be formed to protrude toward the inter-lever so as to be inserted into the inter-lever.

Another exemplary embodiment of the present invention provides a door lock assembly including an actuator disposed inside a housing, a wheel gear connected to the actuator, an inter-lever reciprocating according to the rotation of the wheel gear, and a link lever connected to the inter-lever and operating in conjunction with the inter-lever.

The actuator may include a motor generating a driving force, and a worm gear connected to one side of the motor and rotating.

On the inside of the wheel gear, at least one operation rib may be formed radially from the center to the outside of the wheel gear.

The inter-lever may include a first operation unit formed to protrude toward the wheel gear to be brought into contact with the wheel gear.

The door lock assembly may further include a lock lever connected to a knob disposed inside a vehicle.

The inter-lever may be formed to protrude toward the lock lever to be connected to the lock lever.

The inter-lever may include a third operation unit to protrude toward the link lever to be inserted into the link lever.

The door lock assembly may further include a catchpole disposed inside the housing.

The link lever may include a catchpole operation unit formed to protrude toward the catchpole to be inserted into the catchpole.

The door lock assembly may further include a release lever rotating the catchpole in conjunction with the catchpole according to the movement of the link lever.

Yet another exemplary embodiment of the present invention provides a door lock assembly including a key inserting unit having a key insertion hole to receive a key, a manual lever connected to the key inserting unit and rotating, and a double lock gear brought into contact with one side of the manual lever and rotating according to the rotation of the manual lever.

The key inserting unit may be formed to protrude inside the key inserting hole to be engaged with the key when the key rotates.

The manual lever may be integrally formed with the key inserting unit.

One side of the manual lever may be formed to have a predetermined curvature.

At least a portion of a rear surface of the double lock gear may be formed to protrude toward the manual lever.

The door lock assembly may further include an inter-lever disposed on one side of the double lock gear and having a first elongated hole formed in one surface.

One end of the double lock gear may be formed to protrude inside the first elongated hole to be inserted into the first elongated hole.

Also, the door lock assembly may further include a position sensor sensing the position of the key by sensing rotation of the key inserting unit when the key is inserted into and rotates in the key inserting unit.

The exemplary embodiments of the present invention simplify structures, reduce the manufacturing cost and manufacturing period, and doubly lock a door to prevent a vehicle from being stolen and damaged. Further, the exemplary embodiments of the present invention can simplify an operation of a door lock assembly by an operation of an actuator, and reduce the manufacturing cost.

The exemplary embodiments of the present invention include a manual lever for unlocking a doubly locked door to enable a user to easily manually unlock the locked door by inserting a key. Further, the manipulation of the user is simple and thus the user convenience is improved.

DETAILED DESCRIPTION OF THE EMBODIMENTS

Figure 1:
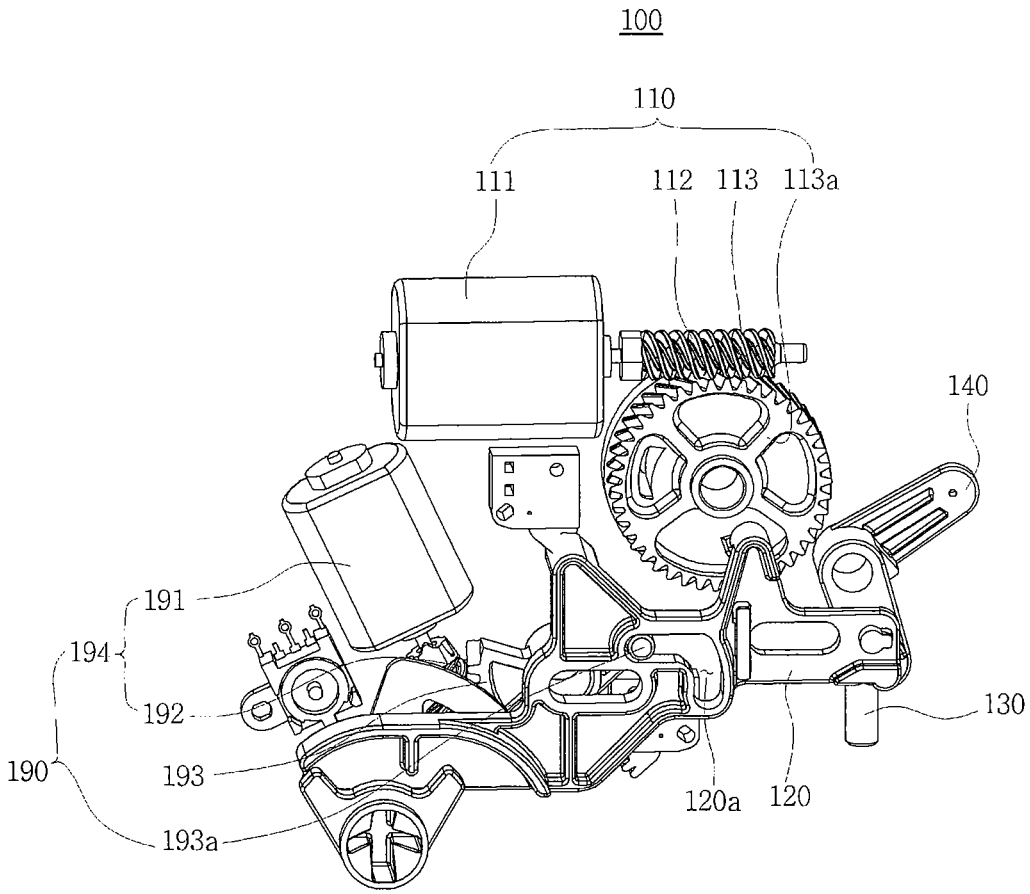
FIG. 1 is a perspective view illustrating a door lock assembly according to an exemplary embodiment of the present invention.

FIG. 1 is a perspective view illustrating a door lock assembly 100 according to an exemplary embodiment of the present invention.

Referring to FIG. 1, the door lock assembly 100 includes a knob (not shown) disposed inside a vehicle. The knob is connected inside the vehicle to be reciprocatory by a user. In this case, the knob may be connected inside the vehicle to move up and down by the user. Further, the knob may be connected inside the vehicle to rotate by the user.

The door lock assembly 100 includes a lock lever 140 connected to the knob. One side of the lock lever 140 is connected to the knob. In this case, the lock lever 140 may be variously connected to the knob. For example, the lock lever 140 may be directly connected to the knob. Further, the lock lever 140 may be connected to the knob by a cable (not shown) which is connected to the knob and the lock lever 140 and transmits the force of the knob to the lock lever 140.

Meanwhile, the door lock assembly 100 includes an inter-lever 120 connected to the lock lever 140. One side of the inter-lever 120 is connected to the lock lever 140. Therefore, the inter-lever 120 moves by an operation of the lock lever 140. Further, the lock lever 140 moves by the inter-lever 120.

The door lock assembly 100 includes a first lock device 110 connected to the inter-lever 120. The first lock device 110 reciprocates the inter-lever 120.

The first lock device 110 includes a first motor 111 generating an action force. The first motor 111 receives a signal from the outside and thus operates.

The first lock device 110 includes a first worm gear 112 connected to one side of the first motor 111. The first worm gear 112 is connected to a shaft of the first motor 111. Therefore, when the shaft rotates, the first worm gear 112 rotates in the same direction as the shaft.

The first lock device 110 includes a wheel gear 113 operating in conjunction with the first worm gear 112. If the first worm gear 112 rotates, the wheel gear 113 rotates. The wheel gear 113 includes at least one operation rib 113*a* which is disposed inside and formed radially from the center.

The at least one operation rib 113*a* includes a plurality of operation ribs. The plurality of operation ribs 113*a* are formed to be spaced apart from each other at predetermined intervals. The plurality of operation ribs 113*a* form a predetermined angle with each other.

Meanwhile, the door lock assembly 100 includes the inter-lever 120 disposed on one side of the wheel gear 113. The inter-lever 120 is brought into contact with one side of the wheel gear 113 and moves according to the rotation of the wheel gear 113.

One side of the inter-lever 120 is connected to the lock lever 140. The lock lever 140 moves according to the movement of the inter-lever 120. Therefore, the user can operate the lock lever 140 by controlling the first motor 111.

On one side of the inter-lever 120, a first elongated hole 120*a* is formed. A portion of the first elongated hole 120*a* may be formed in the longitudinal direction of the inter-lever 120. Another portion of the first elongated hole 120*a* may be formed in a direction different from the longitudinal direction of the inter-lever 120.

The door lock assembly 100 includes a second lock device 190 disposed on one side of the first lock device 110. The second lock device 190 includes a second drive unit 194 generating a driving force.

The second drive unit 194 includes a second motor 191 generating the driving force. The second drive unit 194 includes a second worm gear 192 for transmitting the driving force to the outside. The second worm gear 192 is connected to one side of the second motor 191. The second worm gear 192 rotates according to the rotation of the second motor 191.

Meanwhile, the second lock device 190 includes a double lock gear 193 connected to the second worm gear 192. One side of the double lock gear 193 is formed to protrude toward the inter-lever 120 to be inserted to the inter-lever 120.

The protruding portion of the double lock gear 193 is inserted into the first elongated hole 120*a*. While the second motor 191 rotates, the protruding portion of the double lock gear 193 moves according to the guide of the first elongated hole 120*a*.

Therefore, the door lock assembly 100 can securely lock a door (not shown) through the second lock device 190. Further, since the second lock device 190 is disposed inside a housing (not shown), the size of the door lock assembly 100 is reduced.

Hereinafter, an operation of the door lock assembly 100 will be described in detail.

Figure 2:
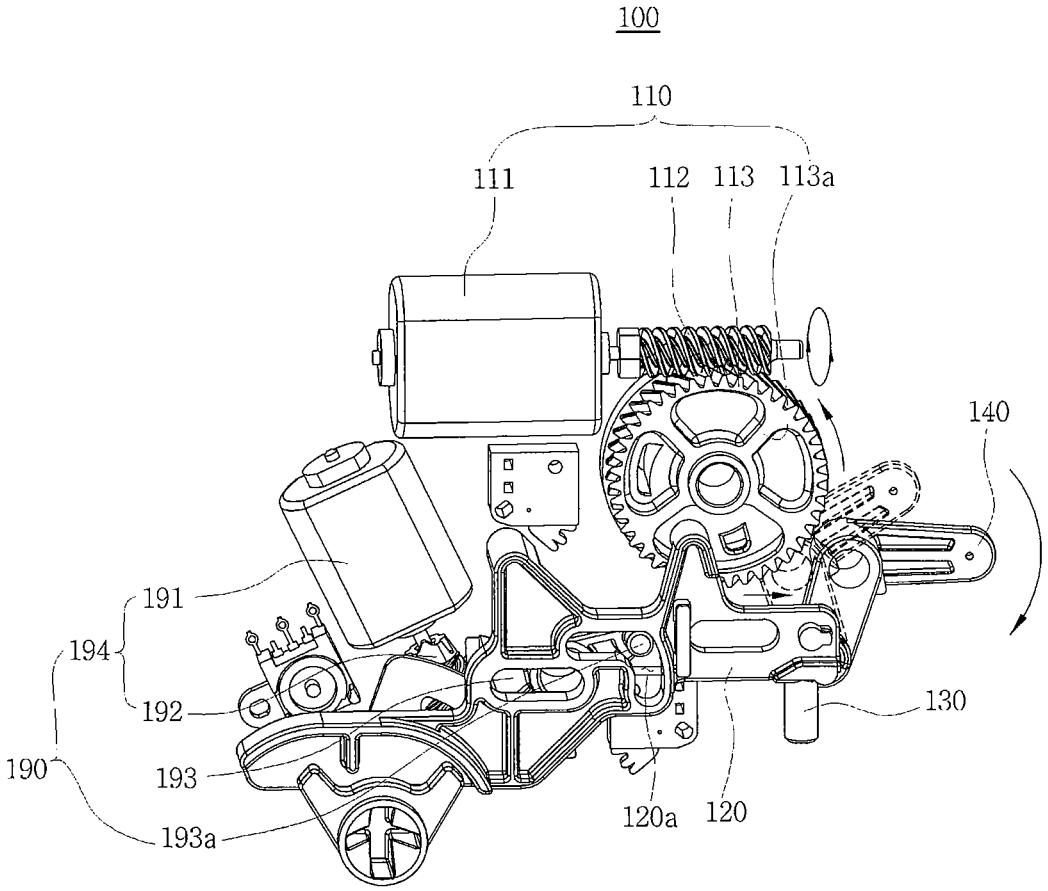
FIG. 2 is an operation state view illustrating a first operation of the door lock assembly shown in FIG. 1.

FIG. 2 is an operation state view illustrating a first operation of the door lock assembly 100 shown in FIG. 1.

Referring to FIG. 2, the door lock assembly 100 locks or unlocks the door. In this case, the user inputs an input signal for locking or unlocking the door through a remote controller (not shown) from the outside.

If the user inputs the input signal, a vehicle controller (not shown) operates the first motor 111 on the basis of the input signal. The input signal includes a first input signal to control the first motor 111 to lock the door. The input signal includes a second input signal to control the first motor 111 to unlock the door.

Further, the input signal includes a third input signal to control the first motor 111 and the second motor 191 to doubly lock the door. The input signal includes a fourth input signal to control the first motor 111 and the second motor 191 to unlock the door from a doubly locked state.

The classification of the input signal may be variously performed. For example, the input signal may be classified on the basis of the number of times of signal inputs which the user repetitively performs several times through the remote controller. Alternatively, the input signal may be classified on the basis of a time period when the user inputs the input signal through the remote controller.

Hereinafter, a case where the user inputs the first input signal will be described in detail.

If the user inputs the first input signal, the first input signal is transmitted to the vehicle controller. The vehicle controller supplies power to the first motor 111 on the basis of the first input signal.

If the power is supplied, the first motor 111 operates. For convenience of explanation, the following explanation will be made assuming a case where the first motor 111 clockwise rotates.

In this case, if the power is supplied, the first motor 111 clockwise rotates by the power. According to the clockwise rotation of the first motor 111, the first worm gear 112 connected to the first motor 111 rotates. Since the first worm gear 112 is connected to the shaft (not shown) of the first motor 111, the first worm gear 112 clockwise rotates by the rotation of the first motor 111.

In this case, the wheel gear 113 rotating in conjunction with the first worm gear 112 rotates. That is, if the first worm gear 112 clockwise rotates, the wheel gear 113 counterclockwise rotates. The rotation direction of the wheel gear 113 is perpendicular to the rotation direction of the first worm gear 112.

While the wheel gear 113 rotates, the plurality of operation ribs 113*a* formed inside the wheel gear 113 rotate. The plurality of operation ribs 113*a* are integrally formed with the wheel gear 113 and rotates in the same direction and at the same speed as the wheel gear 113.

In this case, one of the plurality of operation ribs 113*a* is brought into contact with one side of the inter-lever 120. The operation rib 113*a* brought into contact with the inter-lever 120 applies a force to the inter-lever 120. The force moves the inter-lever 120 in one direction. That is, the inter-lever 120 moves in a right direction of FIG. 2.

Meanwhile, the inter-lever 120 applies a force to the lock lever 140 while moving. The force counterclockwise rotates the lock lever 140. If the lock lever 140 rotates, the knob connected to the lock lever 140 moves upward. Accordingly, the knob moves upward to release an inside handle (not shown) from a restricted state.

The user releases the locked state of the door lock assembly 100 by manipulating the remote controller as described above.

Hereinafter, a case where the user inputs the second input signal will be described in detail.

The user inputs the second input signal through the remote controller. In this case, the vehicle controller controls the first motor 111 on the basis of the second input signal.

If the second input signal is input, the vehicle controller rotates the first motor 111. In the following explanation, directions are based on the above description.

That is, on the basis of the second input signal, the vehicle controller counterclockwise rotates the first motor 111. The first worm gear 112 counterclockwise rotates by the counterclockwise rotation of the first motor 111.

If the first worm gear 112 counterclockwise rotates, the wheel gear 113 clockwise rotates. In this case, the rotation direction of the first worm gear 112 is orthogonal to the rotation direction of the wheel gear 113.

While the wheel gear 113 rotates, the plurality of operation ribs 113*a* rotate. One of the plurality of operation ribs 113*a* is brought into contact with one side of the inter-lever 120 while rotating.

The operation rib 113*a* brought into contact with the inter-lever 120 applies a force to the inter-lever 120. The force moves the inter-lever 120 in the left direction of FIG. 2.

While moving left, the inter-lever 120 rotates the lock lever 140. The lock lever 140 operates the knob while rotating. Therefore, the knob moves down in FIG. 2. In this case, even though the user pulls the inside handle, the user cannot open the door. Therefore, the user can easily lock the door.

Hereinafter, cases where the third input signal and the fourth input signal are applied will be described in detail.

Figure 3:
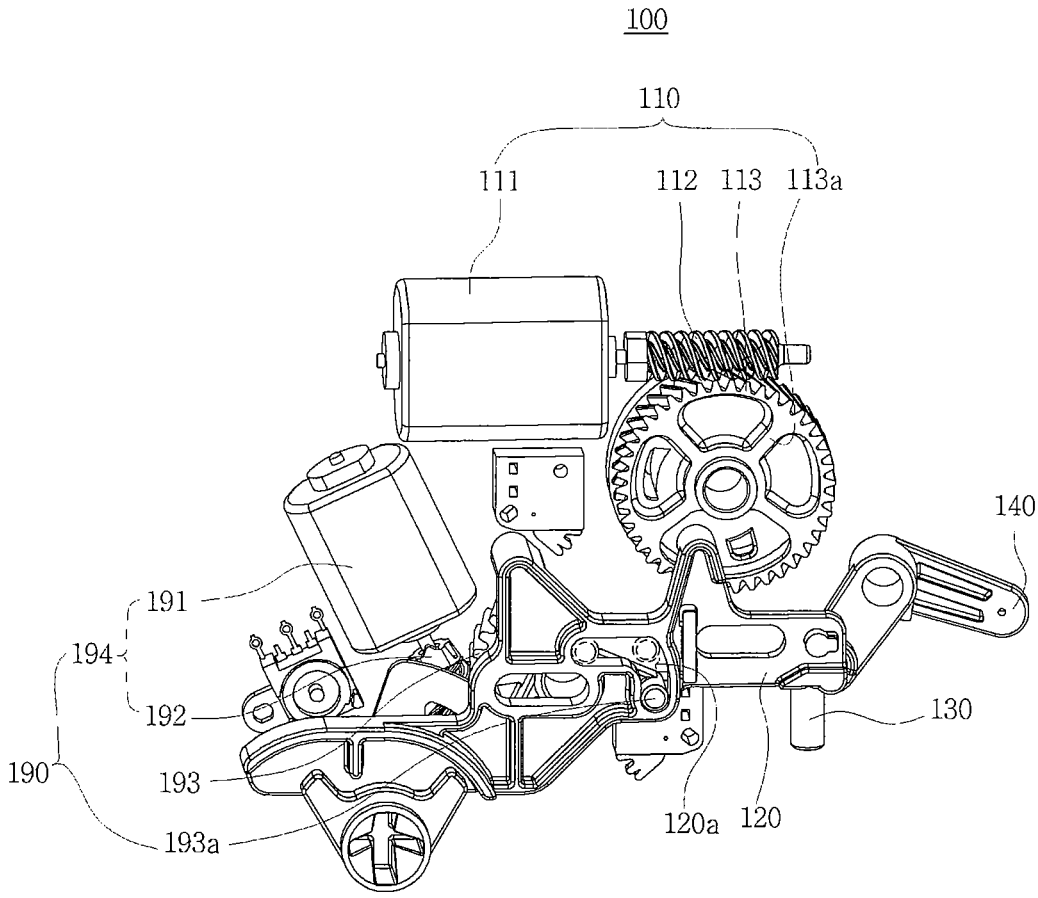
FIG. 3 is an operation state view illustrating a second operation of the door lock assembly shown in FIG. 1.
Figure 4:
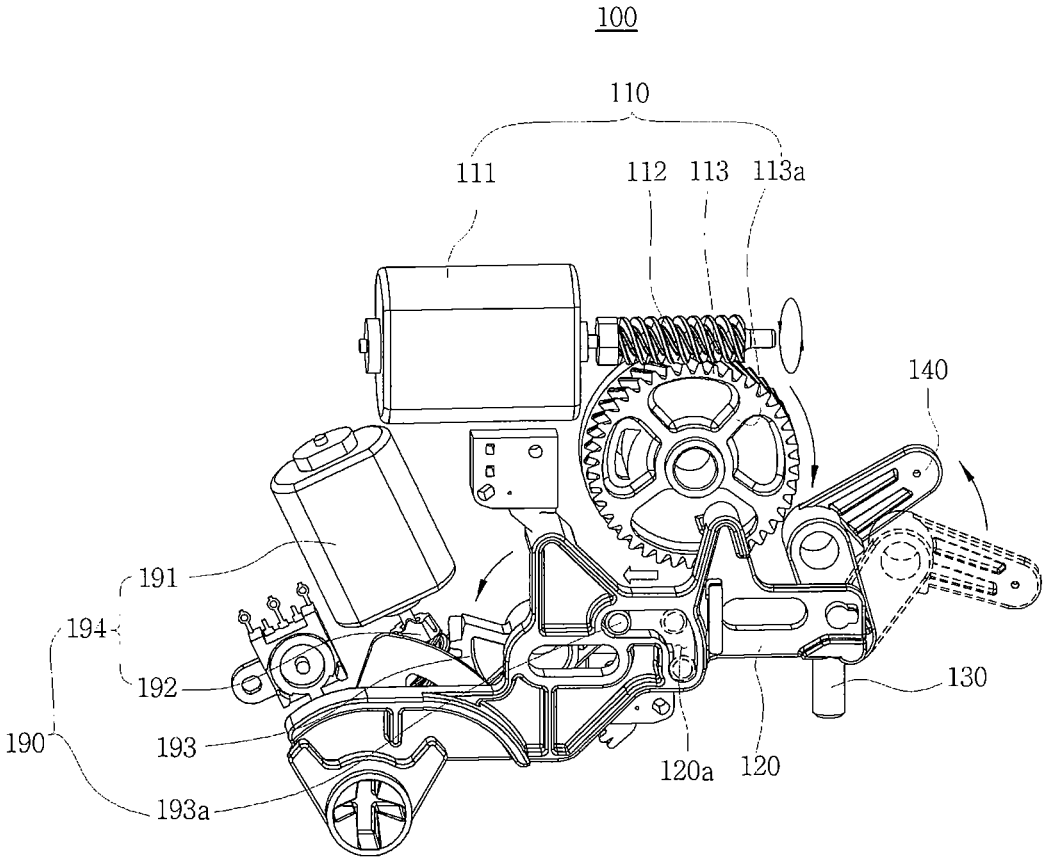
FIG. 4 is an operation state view illustrating a third operation of the door lock assembly shown in FIG. 1.

FIG. 3 is an operation state view illustrating a second operation of the door lock assembly 100 shown in FIG. 1. FIG. 4 is an operation state view illustrating a third operation of the door lock assembly 100 shown in FIG. 1.

Referring to FIGS. 3 and 4, the user inputs the third input signal. In this case, the user manipulates the remote controller such that the first input signal is input during a predetermined period.

For example, in a case where the user inputs the input signal for one second, the vehicle controller recognizes the input signal as the first input signal. In contrast, in a case where the user maintains the input signal for three seconds, the vehicle controller recognizes the input signal as the third input signal.

If the third input signal is input, the vehicle controller drives the first motor 111 and the second motor 191. In this case, the vehicle controller first drives the first motor 111.

If the first motor 111 is driven, the first motor 111 performs the same operation as the case where the first input signal is input, as described above.

Meanwhile, if the driving of the first motor 111 is completed, the vehicle controller drives the second motor 191. The vehicle controller supplies power to the second motor 191. For convenience of explanation, the following explanation will be made assuming a case where the second motor 191 clockwise rotates.

In this case, if the power is supplied, the second motor 191 clockwise rotates by the power. According to the clockwise rotation of the second motor 191, the second worm gear 192 connected to the second motor 191 rotates. The second worm gear 192 is connected to the shaft of the second motor 191 to clockwise rotate by the rotation of the second motor 191.

In this case, the double lock gear 193 rotates in conjunction with the second worm gear 192. That is, if the second worm gear 192 clockwise rotates, the double lock gear 193 clockwise rotates. The rotation direction of the double lock gear 193 is perpendicular to the rotation direction of the second worm gear 192.

If the double lock gear 193 rotates, the protruding portion of the double lock gear 193 moves by a guide of the first elongated hole 120*a*. In this case, the protruding portion of the double lock gear 193 moves to the portion of the first elongated hole 120*a* formed in the longitudinal direction of the inter-lever 120.

The protruding portion of the double lock gear 193 may move to another portion of the first elongated hole 120*a* formed in the direction different from the longitudinal direction of the inter-lever 120. Then, the protruding portion of the double lock gear 193 is fixed to the first elongated hole 120*a*.

Therefore, the protruding portion of the double lock gear 193 prevents the inter-lever 120 form moving. Further, the inter-lever 120 prevents the lock lever 140 from moving, such that the locked state of the door is maintained.

Meanwhile, in a case where the user inputs the fourth input signal, an operation opposite to the case of inputting the third input signal described above is performed.

If the user inputs the fourth input signal, the second motor 191 rotates. According to the rotation of the second motor 191, the second worm gear 192 counterclockwise rotates. By the rotation of the second worm gear 192, the double lock gear 193 counterclockwise rotates.

In this case, the protruding portion of the double lock gear 193 moves in the first elongated hole 120*a* in a direction opposite to the direction described above. The protruding portion of the double lock gear 193 moves in the first elongated hole 120*a*, such that the lock lever 140 is released from the restricted state.

Meanwhile, if the operation of the second motor 191 is completed, the vehicle controller operates the first motor 111. If the first motor 111 operates, the door lock assembly 100 operates in the same way as the case where the second input signal is input. The door is unlocked such that the user can open the door by the operation of the door lock assembly 100.

Therefore, the door lock assembly 100 easily locks or unlocks the door. Further, it is possible to prevent the vehicle from being stolen by operating the double lock gear 193.

Further, the door lock assembly 100 minimizes the components included in the door lock assembly 100 to simplify the structure and reduce the manufacture cost. The door lock assembly 100 stabilizes the door lock assembly 100 through the minimization of the components.

Figure 5:
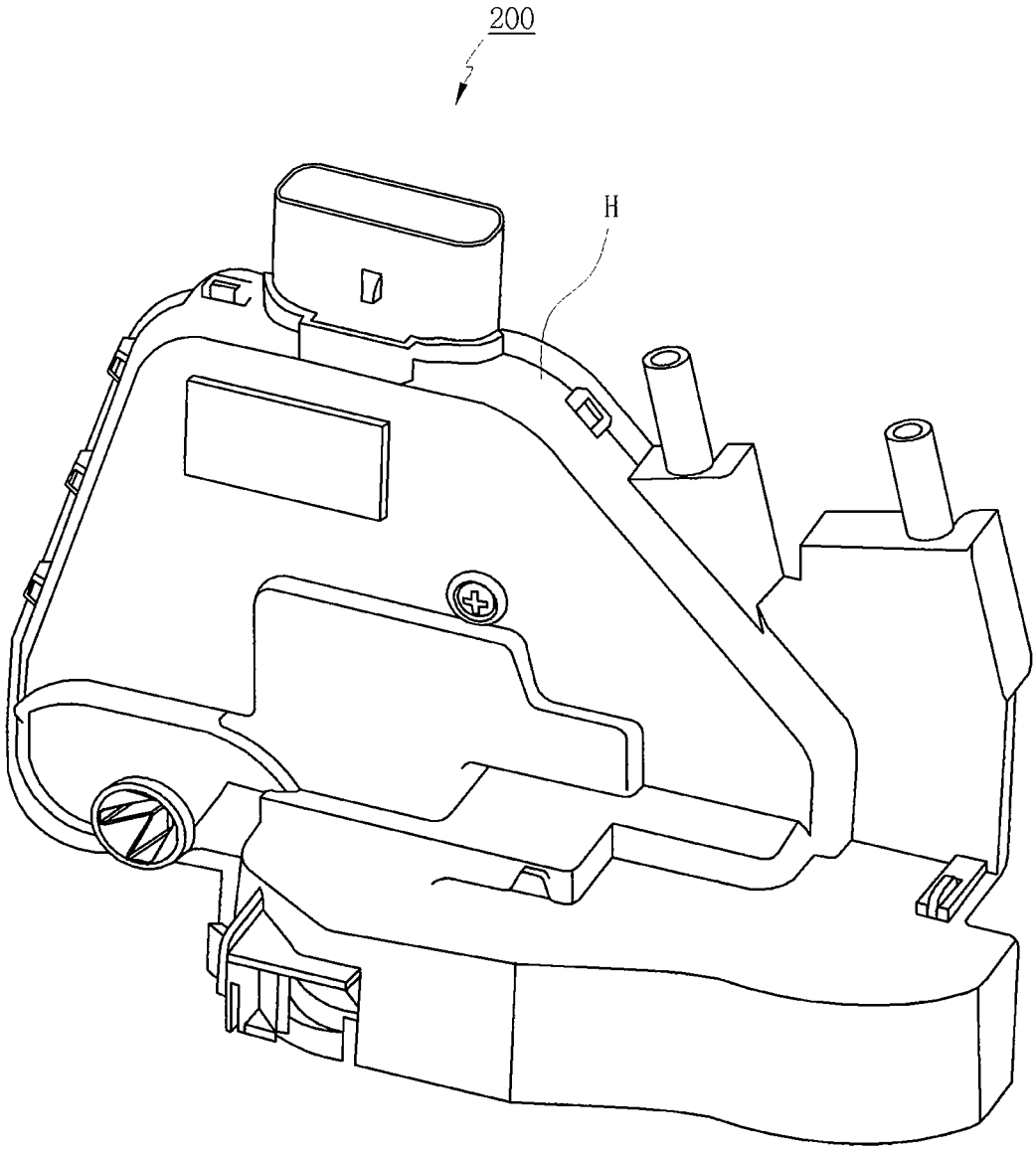
FIG. 5 is a perspective view illustrating a door lock assembly according to another exemplary embodiment of the present invention.
Figure 6:
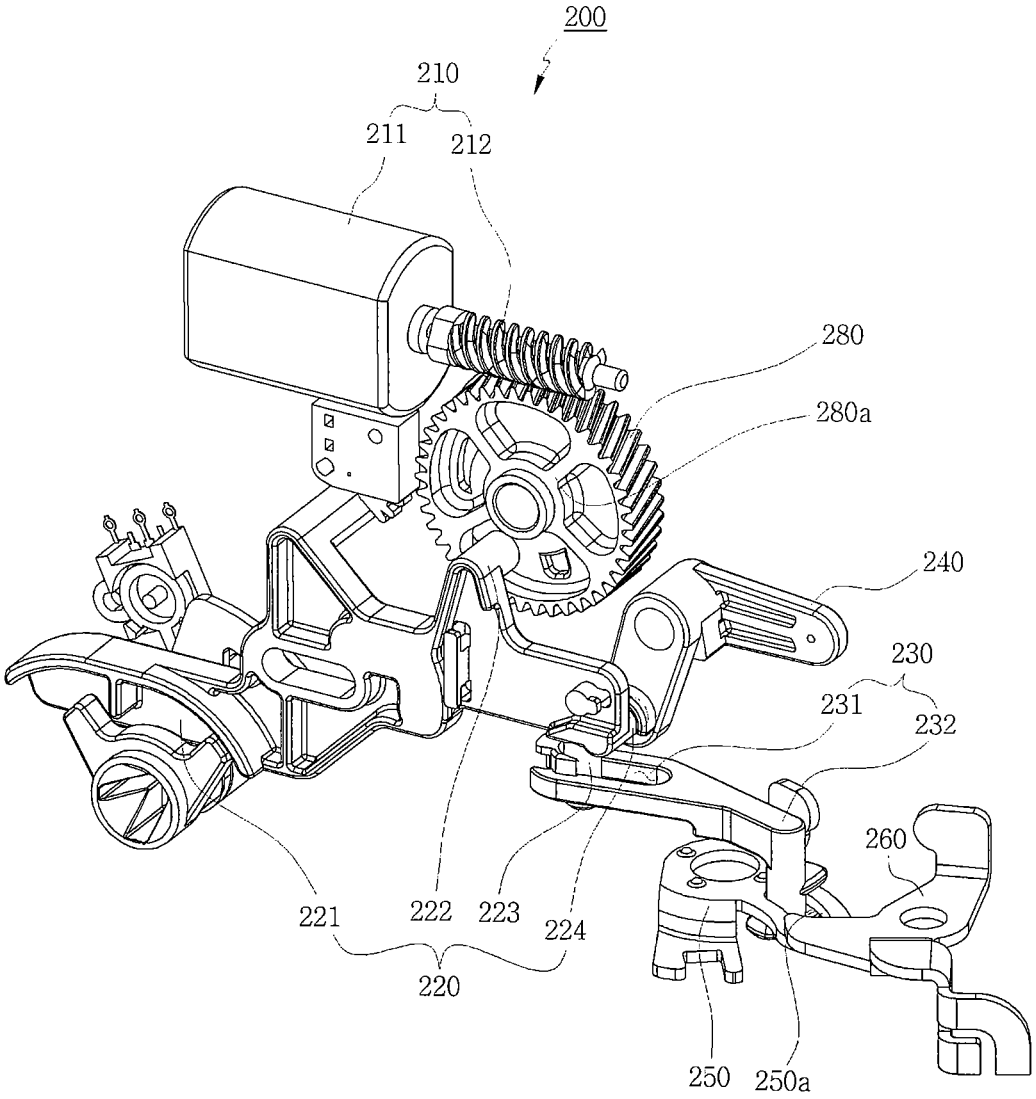
FIG. 6 is a perspective view illustrating an inside of the door lock assembly shown in FIG. 5.

FIG. 5 is a perspective view illustrating a door lock assembly 200 according to another exemplary embodiment of the present invention. FIG. 6 is a perspective view illustrating an inside of the door lock assembly 200 shown in FIG. 5.

Referring to FIGS. 5 and 6, the door lock assembly 200 includes a housing H forming an external appearance. The housing H may be variously formed so that devices are disposed inside the housing H.

The door lock assembly 200 includes a lock lever 240 connected to a knob (not shown) disposed inside the vehicle. The lock lever 240 prevents the door (not shown) from being opened according to the manipulation of the knob by the user.

Further, the door lock assembly 200 includes a catchpole 250 which restricts or releases a striker (not shown). On one side of the catchpole 250, an opening is formed such that the striker is inserted thereto. The catchpole 250 is connected to one side of the housing H to be rotatable.

The door lock assembly 200 includes a release lever 260 which is connected to the catchpole 250 and rotates the catchpole 250. The release lever 260 rotates by manipulation of an outside handle (not shown). The release lever 260 may be disposed on one side of the catchpole 250.

The door lock assembly 100 includes an actuator 210 disposed inside the housing H. The actuator 210 includes a motor 210 generating a driving force. The actuator 210 includes a worm gear 212 connected to the motor 211.

The motor 211 is disposed and stably mounted inside the housing H. One side of the motor 211 is connected to the worm gear 212 rotating according to the driving force of the motor 211.

Meanwhile, the door lock assembly 200 includes a wheel gear 280 connected to the actuator 210. The wheel gear 280 is connected to the worm gear 212. Therefore, if the worm gear 212 rotates according to the driving of the motor 211, the wheel gear 280 rotates.

The wheel gear 280 includes at least one operation rib 280*a* which is formed inside the wheel gear 280 and is radially formed from the center to the outside of the wheel gear 280. The at least one operation rib 280*a* may be a plurality of operation ribs.

The plurality of operation ribs 280*a* are formed to be spaced apart from each other at predetermined intervals. Further, the plurality of operation ribs 280*a* form a predetermined angle with each other. Therefore, in a case whether the wheel gear 280 rotates, it is possible to easily transmit the force to the outside by the plurality of operation ribs 280*a*.

Meanwhile, the door lock assembly 200 includes an inter-lever 220 which is reciprocatory according to the rotation of the wheel gear 280. The door lock assembly 200 includes a link lever 230 whose one side is connected to and which operates in conjunction with the inter-lever 220.

One side of the inter-lever 220 is formed to be in contact with the wheel gear 280. Further, one side of the inter-lever 220 is formed to be in contact with the catchpole 250. One side of the inter-lever 220 is formed to be connected to the link lever 230.

That is, the inter-lever 220 includes a first operation unit 222 formed to protrude toward the wheel gear 280 so as to be brought into contact with the wheel gear 280. The inter-lever 220 includes a second operation unit 223 formed to protrude toward the lock lever 240 so as to be connected with the lock lever 240. Further, the inter-lever 220 includes a third operation unit 224 which is inserted into and connected with one side of the link lever 230.

Meanwhile, in the link lever 230, a second elongated hole 231 is formed to be connected with the third operation unit 224. In this case, the second elongated hole 231 is formed in the longitudinal direction of the link lever 230. The second elongated hole 231 may be elliptically formed.

Further, the link lever 230 includes a catchpole operation unit 232 formed to protrude toward the catchpole 250 so as to be inserted into the catchpole 250. In this case, a third elongated hole 250*a* is formed in the catchpole 250 such that the catchpole operation unit 232 is inserted to the third elongated hole 250*a*. The third elongated hole 250*a* may be formed elliptically in the way same as or similar to the second elongated hole 231.

Hereafter, an operation of the door lock assembly 200 will be described in detail.

Figure 7:
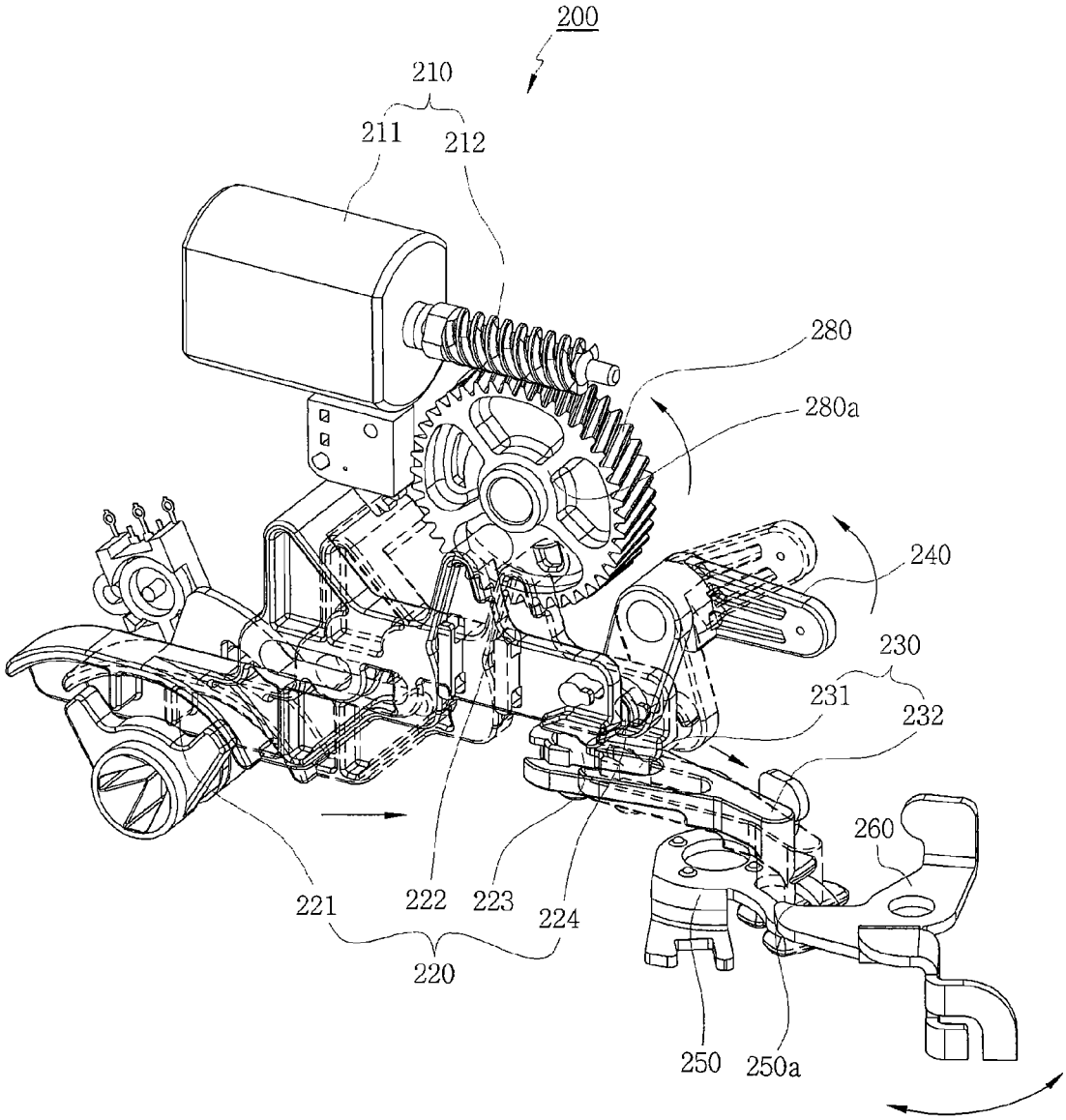
FIG. 7 is an operation state view illustrating a first operation of the door lock assembly shown in FIG. 6.

FIG. 7 is an operation state view illustrating a first operation of the door lock assembly 200 shown in FIG. 6.

Referring to FIG. 7, the door lock assembly 200 locks or unlocks the door. In this case, the user inputs an input signal for restricting or releasing the door through a remote controller (not shown) from the outside.

If the user inputs the input signal, the vehicle controller operates the actuator 210 on the basis of the input signal. The input signal includes a first input signal to control the actuator 210 to maintain the restricted state of the door. The input signal includes a second input signal to control the actuator 210 to make the door to be openable.

Hereinafter, the case where the user inputs the first input signal will be described in detail.

If the user inputs the first input signal, the first input signal is transmitted to the vehicle controller. The vehicle controller supplies power to the actuator 210 on the basis of the first input signal.

If the power is supplied, the actuator 210 operates. For convenience of explanation, an operation of the actuator 210 will be described on the assumption that the motor 211 clockwise rotates.

In this case, if the power is applied, the motor 211 clockwise rotates by the power. According to the clockwise rotation of the motor 211, the worm gear 212 connected to the motor 211 rotates. The worm gear 212 is connected to the shaft (not shown) of the motor 211 to clockwise rotate by the rotation of the motor 211.

In this case, the wheel gear 280 rotating in conjunction with the worm gear 212 rotates. That is, if the worm gear 212 clockwise rotates, the wheel gear 280 counterclockwise rotates. The rotation direction of the wheel gear 280 is perpendicular to the rotation direction of the worm gear 212.

While the wheel gear 280 rotates, the plurality of operation ribs 280*a* formed inside the wheel gear 280 rotate. The plurality of operation ribs 280*a* are integrally formed with the wheel gear 280 and thus rotate at the same speed and in the same direction as the wheel gear 280.

In this case, one of the plurality of operation ribs 280*a* is brought into contact with the first operation unit 222. The operation rib 280*a* brought into contact with the first operation unit 222 applies a force to the first operation unit 222. The force moves the first operation unit 222 in one direction. That is, the first operation unit 222 moves in the right direction of FIG. 7.

While the first operation unit 222 moves, the inter-lever 220 moves at the same time. The inter-lever 220 moves in the same direction as the movement direction of the first operation unit 222.

Meanwhile, if the inter-lever 220 moves, the second operation unit 223 and the third operation unit 224 also move. The second operation unit 223 applies a force to the lock lever 240 while moving.

The force counterclockwise rotates the lock lever 240. If the lock lever 240 rotates, the knob connected to the lock lever 240 moves upward. The knob moves upward to release an inside handle (not shown) from a restricted state.

Meanwhile, the third operation unit 224 moves the second elongated hole 231. In this case, the third operation unit 224 is brought into contact with one side of the inner surface of the second elongated hole 231. The third operation unit 224 applies a force to one side of the second elongated hole 231. According to the movement of the third operation unit 224, the link lever 230 moves. Therefore, a driving force generated in the motor 211 is rapidly and easily transmitted to the link lever 230.

If the link lever 230 moves by the third operation unit 224, a catchpole operation unit 232 moves in the third elongated hole 250*a*. In this case, according to the form of the third elongated hole 250*a*, the catchpole operation unit 232 may rotate.

Meanwhile, the catchpole operation unit 232 moves from one side to the other side of the third elongated hole 250*a*. The catchpole operation unit 232 is disposed such that the release lever 260 and the catchpole 250 operate in conjunction with each other. That is, the catchpole operation unit 232 moves in the third elongated hole 250*a* to be adjacent to one side of the release lever 260.

The release lever 260 operates in conjunction with the outside handle. When a user pulls the outside handle, the release lever 260 rotates. In this case, one side of the release lever 260 is brought into contact with the catchpole operation unit 232.

The release lever 260 applies a force to the catchpole operation unit 232. The catchpole operation unit 232 rotates by the above-mentioned force. The catchpole operation unit 232 pushes one side of the third elongated hole 250*a*. Therefore, the catchpole 250 rotates by the rotation of the catchpole operation unit 232.

The catchpole 250 is separated from the striker while rotating. Therefore, the user can open the door through the outside handle.

Hereinafter, a case where the user inputs the second input signal will be described in detail.

Figure 8:
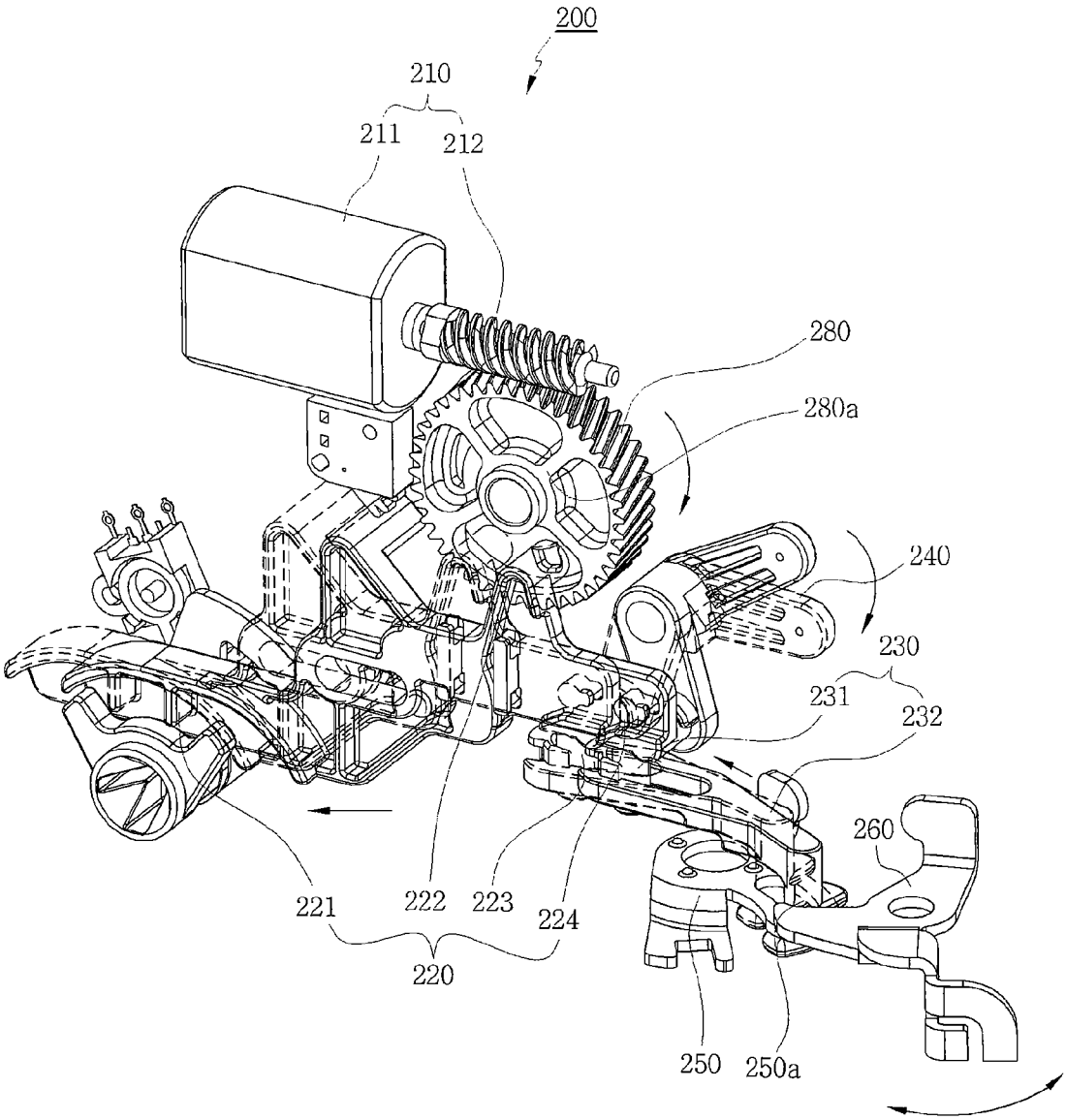
FIG. 8 is an operation state view illustrating a second operation of the door lock assembly shown in FIG. 6.

FIG. 8 is an operation state view illustrating a second operation of the door lock assembly 200 shown in FIG. 6.

Referring to FIG. 8, the user inputs the second input signal through the remote controller. In this case, on the basis of the second input signal, the vehicle controller controls the actuator 210.

If the second input signal is input, the vehicle controller rotates the motor 211. The following explanation will be made with reference to the directions described in FIG. 7.

That is, on the basis of the second input signal, the vehicle controller counterclockwise rotates the motor 211. The worm gear 212 counterclockwise rotates by the counterclockwise rotation of the motor 211.

If the worm gear 212 counterclockwise rotates, the wheel gear 280 clockwise rotates. In this case, the rotation direction of the worm gear 212 is orthogonal to the rotation direction of the wheel gear 280.

Meanwhile, according to the rotation of the wheel gear 280, the plurality of operation ribs 280*a* rotate. One of the plurality of operation ribs 280*a* is brought into contact with the first operation unit 222 while rotating.

The one operation rib 280*a* applies a force to the first operation unit 222. The force applies a force to the first operation unit 222 in the left direction of FIG. 8.

The first operation unit 222 moves in the left direction by the rotation of the one operation rib 280*a*. Further, the inter-lever 220 connected to the first operation unit 222 moves in the left direction.

According to the movement of the inter-lever 220, the second operation unit 223 and the third operation unit 224 also move. The second operation unit 223 rotates the lock lever 240 while moving left.

The lock lever 240 operates the knob while rotating. The knob moves downward in FIG. 8. In this case, the user cannot open the door in spite of pulling the inside handle.

Meanwhile, the third operation unit 224 is brought into contact with the other side of the second elongated hole 231 by the movement of the inter-lever 220. For example, the third operation unit 224 is brought into contact with the side opposite to the second elongated hole 231 described in FIG. 7.

The third operation unit 224 applies a force to the inner surface of the second elongated hole 231. The force moves the link lever 230 left in FIG. 8.

If the link lever 230 moves left, the catchpole operation unit 232 also moves in the left direction of the third elongated hole 250*a*. The catchpole operation unit 232 moves in the left direction of the third elongated hole 250*a* to separate the release lever 260 and the catchpole 250.

That is, in a case where the user applies a force to the outside handle, the release lever 260 rotates. In this case, the release lever 260 rotates but is not brought into contact with the catchpole operation unit 232.

Since the catchpole operation unit 232 is separated from the release lever 260, the catchpole 250 does not rotate. The catchpole 250 continuously restricts the striker.

Therefore, the user maintains the restricted state of the striker by the catchpole 250 through the remote controller.

Hereinafter, a case where the user manually operates the state of the catchpole 250 by using the key will be described in detail.

Figure 9:
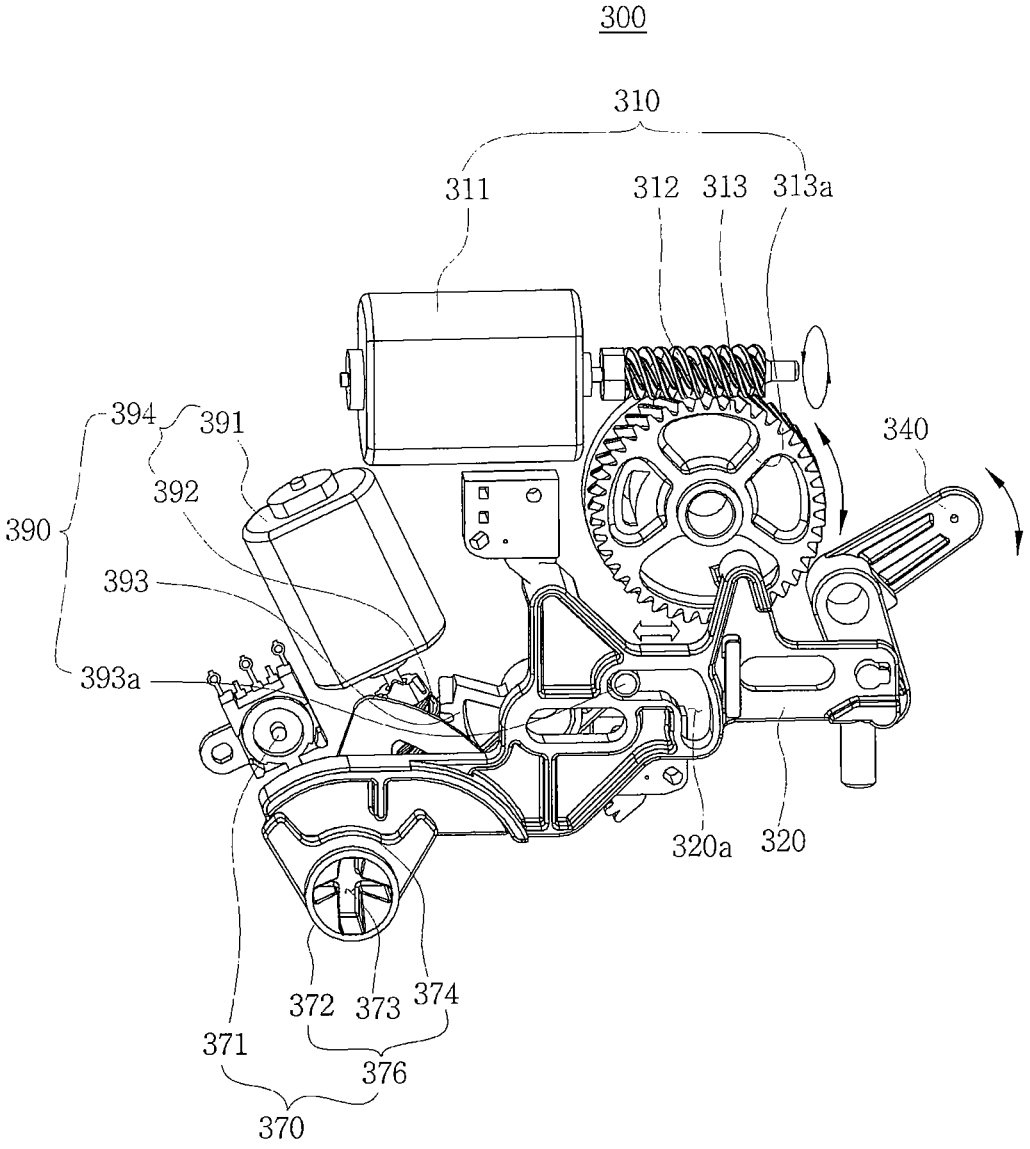
FIG. 9 is a perspective view illustrating a door lock assembly according to a yet another exemplary embodiment of the present invention.

FIG. 9 is a perspective view illustrating a door lock assembly 300 according to a yet another exemplary embodiment of the present invention.

Referring to FIG. 9, the door lock assembly 300 includes a knob (not shown) disposed inside a vehicle. The knob is connected inside the vehicle to be reciprocatory by a user. In this case, the knob may be connected inside the vehicle to move up and down by the user. Further, the knob may be connected inside the vehicle to rotate by the user.

The door lock assembly 300 includes a lock lever 340 connected to the knob. One side of the lock lever 340 is connected to the knob. In this case, the lock lever 140 may be variously connected to the knob. For example, the lock lever 340 may be directly connected to the knob. Further, the lock lever 340 may be connected to the knob by a cable (not shown) which is connected to the knob and the lock lever 340 and transmits the force of the knob to the lock lever 340.

Meanwhile, the door lock assembly 300 includes an inter-lever 320 connected to the lock lever 340. One side of the inter-lever 320 is connected to the lock lever 340. Therefore, the inter-lever 320 operates by an operation of the lock lever 340. Further, the lock lever 140 moves by the inter-lever 320.

The door lock assembly 300 includes a first lock device 310 connected to the inter-lever 320. The first lock device 310 reciprocates the inter-lever 320.

The first lock device 310 includes a first motor 311 generating an action force. The first motor 311 receives a signal from the outside and thus operates.

The first lock device 310 includes a first worm gear 312 connected to one side of the first motor 311. The first worm gear 312 is connected to a shaft of the first motor 311. Therefore, when the shaft rotates, the first worm gear 312 rotates in the same direction as the shaft.

The first lock device 310 includes a wheel gear 313 operating in conjunction with the first worm gear 312. If the first worm gear 312 rotates, the wheel gear 313 rotates. The wheel gear 313 includes at least one operation rib 313*a* which is disposed inside and formed radially from the center.

The at least one operation rib 313*a* includes a plurality of operation ribs. The plurality of operation ribs 313*a* are formed to be spaced apart from each other at predetermined intervals. The plurality of operation ribs 313*a* form a predetermined angle with each other.

Meanwhile, the door lock assembly 300 includes the inter-lever 320 disposed on one side of the wheel gear 313. The inter-lever 320 is brought into contact with one side of the wheel gear 313 and moves according to the rotation of the wheel gear 313.

One side of the inter-lever 320 is connected to the lock lever 340. The lock lever 340 moves according to the movement of the inter-lever 320. Therefore, the user can operate the lock lever 340 by controlling the first motor 311.

On one side of the inter-lever 320, a first elongated hole 320*a* is formed. A portion of the first elongated hole 320*a* may be formed in the longitudinal direction of the inter-lever 320. Another portion of the first elongated hole 320*a* may be formed in a direction different from the longitudinal direction of the inter-lever 320.

The door lock assembly 300 includes a second lock device 390 disposed on one side of the first lock device 310. The second lock device 390 includes a second drive unit 394 generating a driving force. Further, the second lock device 390 includes a double lock gear 393 disposed on one side of a manual lever 377. The double lock gear 393 will be described below in detail.

The second drive unit 394 includes a second motor 391 generating the driving force. The second drive unit 394 includes a second worm gear 392 for transmitting the driving force to the outside. The second worm gear 392 is connected to one side of the second motor 391. The second worm gear 392 rotates according to the rotation of the second motor 391.

The double lock gear 393 is brought into contact with one side of the manual lever 377 and rotates according to the rotation of the manual lever 377. Further, the double lock gear 393 is connected to the second lock device 390.

The double lock gear 393 is connected and operates in conjunction with the second worm gear 392. One side of the double lock gear 393 is formed to protrude toward the inter-lever 320 so as to be inserted into the inter-lever 320.

The protruding portion of the double lock gear 393 is inserted into the first elongated hole 320*a*. According to the rotation of the second motor 391, the protruding portion of the double lock gear 393 moves by a guide of the first elongated hole 320*a*.

Therefore, the door lock assembly 300 can securely a door (not shown) through the second lock device 390. Further, since the second lock device 390 is disposed inside a housing (not shown), the size of the door lock assembly 300 is reduced.

The door lock assembly 300 includes a double-door-lock releasing device 370 capable of manually releasing the double lock gear 393 from the restricted state. The double-door-lock releasing device 370 includes a key inserting unit 376 with a key insertion hole 373 so that an outside user inserts a key (not shown).

The double-door-lock releasing device 370 includes the manual lever 377 which rotates in connection with the key inserting unit 376.

Meanwhile, the key inserting unit 376 includes an insertion unit 372 into which the user inserts the key. The key inserting unit 376 is formed on one side of the insertion unit 372 and includes a connection unit 374 connected to the inter-lever 320. The insertion unit 372 and the connection unit 374 may be integrally formed.

On one side of the insertion unit 372, the insertion hole 373 is formed to be recessed inside to receive the key. Further, the inner surface of the insertion hole 373 is formed to correspond to the shape of the key such that the key is inserted and fixed therein.

At least a portion of the connection unit 374 protrudes to apply an action force of the inter-lever 220. The protruding portion is brought into contact with the inter-lever 220 to apply the action force to the inter-lever 220 when the key inserting unit 376 rotates.

Meanwhile, the double-door-lock releasing device 370 includes a position sensor 371 disposed on one side of the insertion unit 372. The position sensor 371 senses the position of the key according to an operation of the key.

The position sensor 371 senses the position of the key and transmits a signal to a vehicle controller (not shown). On the basis of the signal, the vehicle controller operates the actuator 310 or prevents the actuator 310 from operating.

Therefore, even when the actuator 210 is broken out, the user can easily manually operate the door lock assembly 300.

Figure 10:
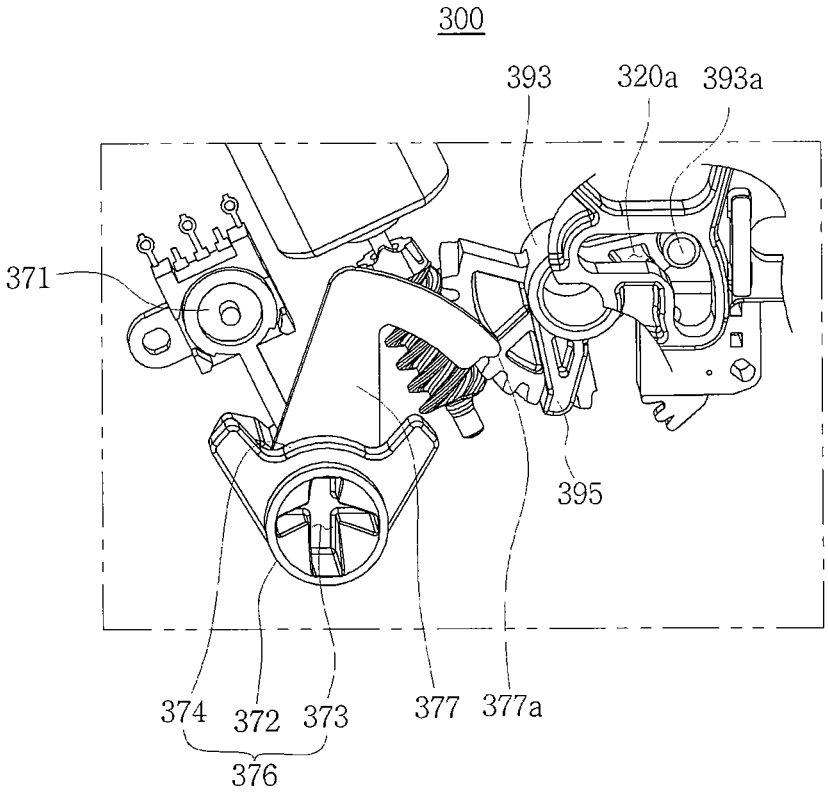
FIG. 10 is a perspective view illustrating an embodiment of the double-door-lock releasing device shown in FIG. 9.

FIG. 10 is a perspective view illustrating an embodiment of the double-door-lock releasing device 370 shown in FIG. 9.

Referring to FIG. 10, the double-door-lock releasing device 370 includes the key inserting unit 376, the manual lever 377, and the double lock gear 393, as described above.

In one surface of the key inserting unit 376, the key insertion hole 373 is formed to be recessed inside. The key insertion hole 373 may be formed to correspond to the shape of the key.

The inner surface of the key insertion hole 373 is formed to protrude toward the inner surface to be engaged with the key when the key rotates. The key insertion hole 373 may be formed in a cross shape.

Meanwhile, the manual lever 377 is connected to the key inserting unit 376 to operate in conjunction with the key inserting unit 376. The manual lever 377 may be integrally formed with the key inserting unit 376 to operate in conjunction with the key inserting unit 376.

One side of the manual lever 377 may be formed to have a predetermined curvature. The manual lever 377 may be formed to be curved toward the double lock gear 393.

Meanwhile, on one side of the key inserting unit 376, an elastic unit (not shown) is connected. The elastic unit provides a restoring force to the key inserting unit 376 to restore the key inserting unit 376 to the original state after the key inserting unit 376 rotates.

Hereinafter, an operation of the double-door-lock releasing device 370 will be described in detail.

Figure 11:
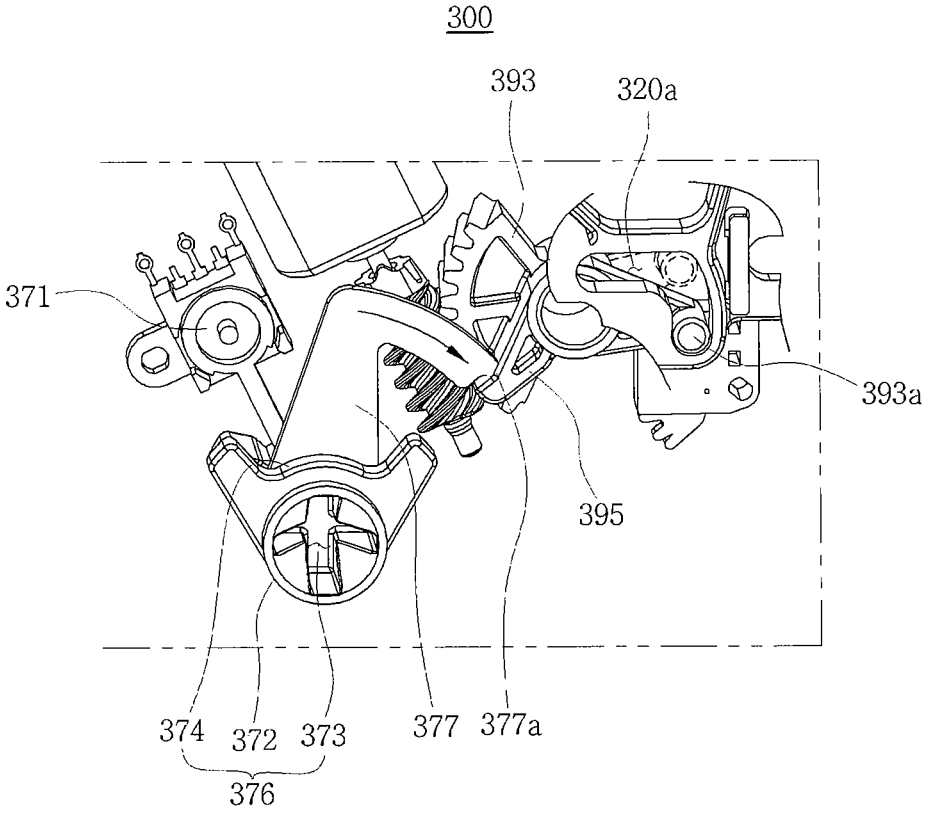
FIG. 11 is an operation state view illustrating an operation of the double-door-lock releasing device shown in FIG. 10.

FIG. 11 is an operation state view illustrating an operation of the double-door-lock releasing device 370 shown in FIG. 10.

Referring to FIG. 11, in a case where the vehicle controller controlling the first motor 311 and the second motor 391 is broken out or a battery (not shown) is discharged, the user manually locks or unlocks the door.

In this case, the user inserts the key into the key insertion hole 373. After inserting the key, the user rotates the key. In this case, the user clockwise rotates the key. According to the rotation of the key, the double-door-lock releasing device 370 operates.

Hereinafter, a case where the door lock assembly 300 is unlocked when the key clockwise rotates will be mainly described for convenience of explanation.

If the user clockwise rotates the key, the key applies a force to the inner wall of the key insertion hole 373. Therefore, according to the rotation of the key, the key inserting unit 376 also clockwise rotates.

If the key inserting unit 376 rotates, the portion with the curvature of the key inserting unit 376 also rotates. Therefore, the portion with the curvature is brought into contact with the double lock gear 393.

If the key inserting unit 376 continues to rotate, the portion with the curvature applies a force to the double lock gear 393. The force counterclockwise rotates the double lock gear 393.

If the double lock gear 393 counterclockwise rotates, as described above, the protruding portion of the double lock gear 393 moves along the first elongated hole 320*a*. The double lock gear 393 moves upward in the first elongated hole 120*a* so as to release the inter-lever 320 from a restricted state.

In this case, the key inserting unit 376 applies a force to the inter-lever 320 while rotating. Accordingly, the inter-lever 320 moves to the direction of the force.

That is, in a case where the key inserting unit 376 rotates, the door lock assembly 300 operates in the same way as the case of inputting the third input signal. Therefore, even in a case where the first motor 311 and second motor 391 do not operate, the user can easily manually unlock the door.

As described above, the double-door-lock releasing device 370 can easily manually operate the door lock assembly 300 in a case where the battery is discharged or electric devices such as the first motor 311 and the second motor 391 are defective.

Further, the double-door-lock releasing device 370 is mechanically designed to have a simple structure, whereby the cost and time necessary to an assembling process are reduced.

Although the exemplary embodiments of the present invention have been described, it can be apparent to those skilled in the art that the present invention can be changed and modified in various forms by addition, change, removal, or supplement of a component within the sprite and scope of the present invention described in claims and these changes and modifications are included in the scope of the present invention.

What is claimed is:

1. A door lock assembly, comprising:

an actuator disposed inside a housing;

a wheel gear connected to the actuator;

an inter-lever reciprocating according to the rotation of the wheel gear;

a link lever having one side connected to the inter-lever and operating in conjunction with the inter-lever;

a lock lever connected to a knob disposed inside a vehicle;

a catchpole disposed inside the housing, wherein the catchpole has an elongated hole formed therein; and a release lever rotating the catchpole in conjunction with the catchpole according to the movement of the link lever, wherein the link lever includes a catchpole operation unit formed to protrude toward the catchpole such that the catchpole operation unit is inserted in the elongated hole.

2. The door lock assembly according to claim 1, wherein the actuator includes a motor generating a driving force, and a worm gear connected to one side of the motor and rotating.

3. The door lock assembly according to claim 1, wherein, on the inside of the wheel gear, at least one operation rib is formed radially from the center to the outside of the wheel gear.

4. The door lock assembly according to claim 1, wherein the inter-lever includes a first operation unit formed to protrude toward the wheel gear so as to be brought into contact with the wheel gear.

5. The door lock assembly according to claim 1, wherein the inter-lever includes a second operation unit formed to protrude toward the lock lever so as to be connected to the lock lever.

6. The door lock assembly according to claim 1, wherein the inter-lever includes a third operation unit formed to protrude toward the link lever so as to be inserted into the link lever.

* * * * *